US011019855B2

(12) United States Patent
Aihara

(10) Patent No.: US 11,019,855 B2
(45) Date of Patent: Jun. 1, 2021

(54) VORTEX-GENERATOR DEVICE

(71) Applicant: NIKE, Inc., Beaverton, OR (US)

(72) Inventor: Yuki Aihara, Portland, OR (US)

(73) Assignee: NIKE, INC., Beaverton, OR (US)

( * ) Notice: Subject to any disclaimer, the term of this patent is extended or adjusted under 35 U.S.C. 154(b) by 0 days.

(21) Appl. No.: 15/991,392

(22) Filed: May 29, 2018

(65) Prior Publication Data

US 2018/0343935 A1 Dec. 6, 2018

Related U.S. Application Data

(60) Provisional application No. 62/513,238, filed on May 31, 2017.

(51) Int. Cl.

| | |
|---|---|
| ***A41D 13/00*** | (2006.01) |
| ***A41D 1/04*** | (2006.01) |
| ***A41D 1/08*** | (2018.01) |
| ***A41D 7/00*** | (2006.01) |
| ***F15D 1/00*** | (2006.01) |

(Continued)

(52) U.S. Cl.

CPC ..... *A41D 13/0015* (2013.01); *A41D 1/04* (2013.01); *A41D 1/08* (2013.01); *A41D 7/00* (2013.01); *F15D 1/003* (2013.01); *F15D 1/0085* (2013.01); *F15D 1/12* (2013.01); *A41D 13/00* (2013.01); *A41D 13/002* (2013.01); *A41D 13/015* (2013.01); *A41D 13/0156* (2013.01); *A41D 31/04* (2019.02); *A41D 31/185* (2019.02); *A41D 2400/24* (2013.01); *A41D 2600/10* (2013.01)

(58) Field of Classification Search

CPC .. A41D 13/0015; A41D 13/00; A41D 13/002; A41D 13/015; A41D 13/0156; A41D 31/04; A41D 1/04; A41D 1/08; A41D 7/00; A41D 2400/24; A41D 2600/10; A41D 31/185; F15D 1/003; F15D 1/0085; F15D 1/12

USPC ..... 2/69

See application file for complete search history.

(56) References Cited

U.S. PATENT DOCUMENTS 5,033,116 A * 7/1991 Itagaki ..... A41D 7/00 114/67 R
5,734,990 A * 4/1998 Waring ..... A41D 7/00 2/10

(Continued)

FOREIGN PATENT DOCUMENTS

CN 103519427 A 1/2014
CN 203555186 U 4/2014

(Continued)

OTHER PUBLICATIONS

International Preliminary Report on Patentability dated Dec. 12, 2019 in International Patent Application No. PCT/US2018/035166, 9 pages.

(Continued)

*Primary Examiner* — Khaled Annis
*Assistant Examiner* — Dakota Marin
(74) *Attorney, Agent, or Firm* — Shook, Hardy & Bacon L.L.P.

(57) ABSTRACT

An article that includes a vortex-generator device may include various features. For example, the article may include a material layer and one or more elongate members coupled to the material layer. In addition, the one or more elongate members interconnect two or more vortex generators.

17 Claims, 9 Drawing Sheets

(51) Int. Cl.

| | |
|---|---|
| ***F15D 1/12*** | (2006.01) |
| *A41D 31/18* | (2019.01) |
| *A41D 13/015* | (2006.01) |
| *A41D 13/002* | (2006.01) |
| *A41D 31/04* | (2019.01) |

(56) References Cited

U.S. PATENT DOCUMENTS

| | | | | |
|---|---|---|---|---|
| 9,101,171 | B2 * | 8/2015 | Brandt | A63B 71/12 |
| 10,238,156 | B2 * | 3/2019 | Cumiskey | A41D 13/0015 |
| 2006/0059609 | A1 * | 3/2006 | Moss | A41D 13/0506 2/455 |
| 2011/0265242 | A1 * | 11/2011 | Lambertz | A41D 1/08 2/69 |
| 2012/0131720 | A1 * | 5/2012 | Nordstrom | A41D 13/0015 2/69 |
| 2012/0210487 | A1 * | 8/2012 | Albin | A41D 1/08 2/69 |
| 2015/0101110 | A1 * | 4/2015 | Wagner | A41D 13/015 2/455 |
| 2016/0066626 | A1 * | 3/2016 | Gildersleeve | A41D 13/015 428/43 |
| 2016/0345641 | A1 * | 12/2016 | Aihara | A41D 13/0015 |

FOREIGN PATENT DOCUMENTS

| | | | |
|---|---|---|---|
| EP | 0411351 | A1 | 2/1991 |
| WO | 2016191466 | A1 | 12/2016 |

OTHER PUBLICATIONS

Li Wen et al: "Hydrodynamic function of biomimetic shark skin: effect of denticle pattern and spacing", Bioinspiration & Biomimetics, Institute of Physics Publishing, Bristol, GB, vol. 10, No. 6, Nov. 18, 2015 (Nov. 18, 2015), p. 66010, XP02O293332, ISSN: 1748-3190, DOI:10.1088/1748-3190/10/6/066010, [retrieved on Nov. 18, 2015].

International Search Report and Written Opinion dated Sep. 3, 2018 in International Patent Application No. PCT/US2018/035166, 17 pages.

Office Action received for European Patent Application No. 18735010.3, dated Nov. 16, 2020, 6 pages.

* cited by examiner

VORTEX-GENERATOR DEVICE

CROSS-REFERENCE TO RELATED APPLICATIONS

This application claims benefit of U.S. Provisional Application 62/513,238 filed on May 31, 2017 and entitled Vortex-Generator Device. The entirety of the aforementioned application is incorporated by reference herein.

TECHNICAL FIELD

This disclosure relates to a plurality of vortex generators that are interconnected with one another.

BACKGROUND

Vortex generators typically include some type of protuberance extending from a surface of a body and configured disrupt a boundary layer of a fluid (e.g., air, water, etc.) passing over the surface. As such, in some instances, the vortex generators affect drag properties when the body is in motion.

BRIEF DESCRIPTION OF THE DRAWINGS

This disclosure describes various subject matter, some of which is depicted in the figures that are briefly described below and that are incorporated herein by reference.

DETAILED DESCRIPTION

Figure 1A:
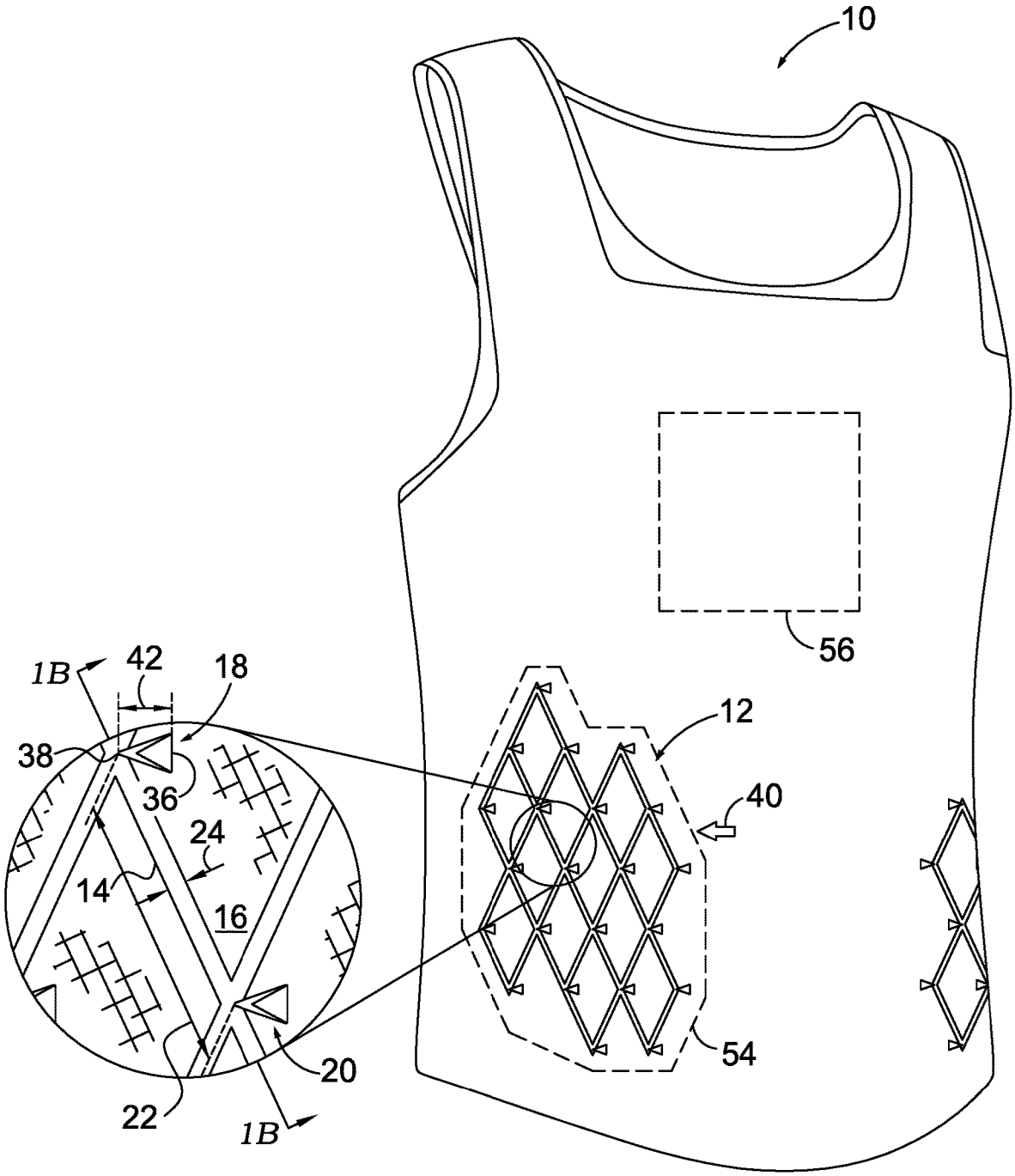
FIG. 1A depicts an upper-body garment that includes a vortex-generator device in accordance with an aspect of this disclosure.

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are equivalent to the ones described in this disclosure. In other words, the intended scope of the claims, and the other subject matter described in this specification, includes equivalent features, aspects, materials, methods of construction, and other aspects not expressly described or depicted in this application in the interests of concision, but which would be understood by an ordinarily skilled artisan in the relevant art in light of the full disclosure provided herein as being included within the scope. It will be understood that certain features and subcombinations are of utility and may be employed without reference to other features and subcombinations. This is contemplated by and is within the scope of the claims.

This disclosure describes an article that includes a vortex-generator device affixed to a surface. The vortex-generator device generally includes at least one elongate member that interconnects two or more vortex generators. The vortex-generator device might be affixed to a variety of different articles, such as a garment, clothing accessory (e.g., footwear, gloves, headwear, etc.), adhesive tape, athletic equipment, and the like in order to affect drag properties of the article. Among other things, features of the vortex-generator device may provide stability to each of the individual vortex generators and may provide a mechanism by which the two or more vortex generators can be handled collectively, instead of individually, such as when the vortex-generator device is affixed to the article. In additional instances, the vortex-generator device may affect properties of the underlying article, such as by reducing relative stretch in a portion of the article.

One aspect of the disclosure includes an article of apparel having a material layer, an elongate member coupled to a surface of the material layer, and a first and second vortex generator coupled to the elongate member. The elongate member has an elongate-member length and an elongate-member width. The elongate-member length extends from the first vortex generator to the second vortex generator, and the elongate-member width is less than the elongate-member length. In addition, each of the first vortex generator and the second vortex generator includes a leading edge and a trailing edge opposite the leading edge. The leading edge and the trailing edge define a vortex-generator length therebetween, and the elongate-member width and the vortex-generator length comprise a ratio in a range of about 1.5:1 to about 0.25:1.

Another aspect of the disclosure includes an article with a vortex-generator device. The article includes a material layer having a surface. A plurality of elongate members is coupled to the surface, and the elongate members are interconnected with one another. In addition, each elongate member of the plurality of elongate members includes an elongate-member length and an elongate-member width, the elongate-member width being less than the elongate-member length. Further, at least two elongate members included in the plurality of elongate members intersect at a vertex to form an angle. The article also includes a plurality of vortex generators that are coupled to the plurality of elongate members and that protrude away from the surface. Each elongate-member length extends between a respective pair of vortex generators, and at least one of the vortex generators is coupled at the vertex.

A further aspect of the disclosure is directed to a method of constructing a vortex-generator device. The method includes filling a vortex-generator-device mold with an elastomeric composition in a first state. The vortex-generator-device mold includes a plurality of vortex-generator-shaped depressions having a first depth and one or more grooves connecting the vortex-generator shaped depressions to one another. The one or more grooves have a second depth that is less than the first depth. The elastomeric composition is cured to a second state while the elastomeric composition is in the vortex-generator-device mold, such that the elastomeric composition forms a vortex-generator device when cured. The method also includes applying a bonding agent to a surface of the vortex-generator device, the surface being positioned near a mouth of the one or more grooves. The bonding agent is cured while the vortex-generator device is in the vortex-generator device mold. The vortex-generator device is transferred to a jig having a cavity shape that is complementary to the vortex-generator device, such that the surface with the bonding agent is exposed. A material layer is placed against the surface with the bonding agent, and the bonding agent is activated to couple the vortex-generator device to the material layer.

Figure 1B:
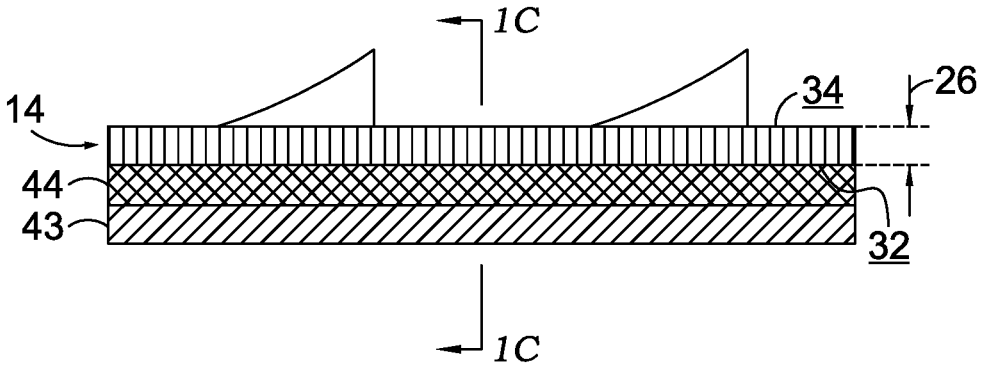
FIG. 1B depicts a cross-section view taken from the cross-section reference plane indicated in FIG. 1A.
Figure 1C:
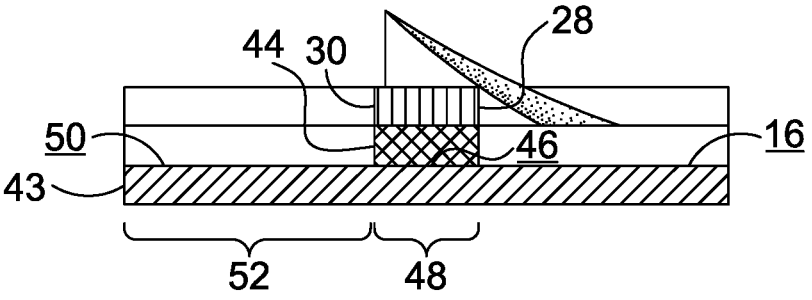
FIG. 1C depicts a cross-section view taken from the cross-section reference plane indicated in FIG. 1B.

Having described various aspects of the present disclosure, reference will now be made to the figures to further describe these aspects, as well as other aspects. FIG. 1A depicts one type of article 10 that includes a vortex-generator device 12 coupled thereto. The article 10 includes an upper-torso garment, which is exemplary of one type of garment to which the vortex-generator device 12 might be coupled. FIG. 1A also includes a magnified view that depicts portions of the vortex-generator device 12 in greater detail for illustrative purposes. In addition, FIGS. 1B and 1C illustrate respective cross sections that depict other aspects of the vortex-generator device. The depictions provided by FIGS. 1B and 1C are schematic in nature and are not necessarily meant to illustrate or depict accurate scaling of layer thickness or vortex-generator-device sizing or spacing.

As depicted in the magnified view, the vortex-generator device 12 includes an elongate member 14, which is coupled to a surface 16 of the article 10. In addition, a first vortex generator 18 and a second vortex generator 20 are coupled to the elongate member 14. The vortex generators 18 and 20 make up a subset of a larger number of vortex generators, which are illustrated on the non-magnified view of the article 10, and the larger number of vortex generators depicted on the article 10 are interconnected by a series of other elongate members. When the article 10 is in use, such as when a person wearing the article 10 is in motion (e.g., running, jumping, sprinting, etc.), the vortex generators 18 and 20 protrude away from the surface 16 and operate to disrupt a boundary layer, thereby affecting drag properties of the article 10. Among other things, the elongate member 14 provides additional support and stability for the vortex generators 18 and 20 and may also affect properties of the article 10.

Generally, an elongate member (e.g., elongate member 14) includes a body that extends in three dimensions (e.g., x, y, and z axes), such that the body has an elongate-member length, an elongate-member width, and an elongate-member thickness, the elongate-member length being larger than the elongate-member width and the elongate-member thickness. Examples of an elongate-member length 22, an elongate-member width 24, and an elongate-member thickness 26 are illustratively depicted in FIGS. 1A-1C. That is, the elongate member 14 includes an elongate-member length 22, which extends from the first vortex generator 18 to the second vortex generator 20, and in this respect, the dimensionality of the elongate member (i.e., in which axis the length extends in the three-dimensional reference space) may be determined by the two vortex generators 18 and 20. The two vortex generators 18 and 20 may represent terminal end-points of the elongate member 14, or the elongate member 14 may extend past the vortex generators as depicted in FIG. 1. The length 22 may be measured by a straight line when the elongate member is straight. And in instances in which the elongate member is not straight (e.g., curved, zigzag, etc.), then the length may be measured as the traced length of the elongate member from one point to another point.

The elongate member 14 also includes sides or edges 28 and 30 (FIG. 1C) that extend along the length of the elongate member 14. The width 24 is measured from one side to the other side along an axis perpendicular to the length 22 at a point on the elongate member 14, and generally, the width is smaller than the length 22. Furthermore, the elongate member 14 includes a first surface 32 that faces towards the article surface 16 and a second surface 34 that faces in a direction opposite from the first surface 32, and the first and second surfaces 32 and 34 also extend along the length of the elongate member 14. The thickness 26 is measured from one surface to the other surface along an axis perpendicular to the width 24 and is generally smaller than the length 22. The cross-sectional view of the elongate member 14 provided in FIG. 1C illustrates a rectangular cross-section, and in other aspects, the elongate member 14 may include various other cross sections, including (but not limited to) circular, ovular, square, polygonal, semi-circular, semi-ovular, and organically shaped.

Generally, a vortex generator includes a protuberance that extends away from the article surface 16 and that is configured to engage the boundary layer of a fluid medium passing over the surface. A vortex generator may include various shapes and configurations, including (but not limited to) dart-shaped, vane-shaped, triangular, hemispherical, cylindrical, polygonal prismatic, polygonal pyramidal, and the like. The exemplary vortex generators 18 and 20 depicted in FIGS. 1A-1C are dart shaped.

A vortex generator may include various dimensions, such as a vortex-generator length and a vortex-generator height. As depicted in the magnified view of FIG. 1A, the vortex generator 18 includes a vortex-generator length 42 extending from a leading edge 36 to a trailing edge 38. Typically, the leading edge is oriented on a surface to face in a direction opposite to the direction in which a fluid (e.g., water or air) passes, such as when the fluid is flowing over the surface or when the surface moves through the fluid. The trailing edge faces towards the direction in which the fluid is flowing or in which the fluid passes when the article moves. Accordingly, the leading edge is oriented to engage the fluid before the trailing edge, and the trailing edge is "downstream" of the leading edge. For example, when the article 10 is worn by a person moving in a forward direction, air would flow in the direction of the arrow 40, such that the leading edge 36 would engage the air flow before the trailing edge 38. Although vortex generators arranged on the article 10 include the dart-shaped configuration depicted in FIGS. 1A-1C, any alternative vortex-generator configuration or shape would similarly include a leading edge facing opposite the arrow 40 and a trailing edge facing in the same direction as the arrow 40.

The vortex-generator device 12 includes additional features as well. For example, as described in other parts of this disclosure, the vortex-generator device 12 is coupled to the surface 16 of the article 10, which is formed by a textile layer 43. In one aspect, the vortex-generator device 12 is bonded or adhered to the surface 16, such that a bonding-material layer 44 is layered directly between the surface 32 of the elongate member and the surface 16 of the article. As such, the surface 16 includes a first surface portion 46 that engages with the bonding layer 44 and that is attached directly to the vortex-generator device. The first surface portion 46 is formed by a first set of yarn strands 48 (or fibers), which might be formed into the textile layer by various manufacturing techniques, including knitting, woven, non-woven, braiding, and the like. In addition, the surface 16 includes a second surface portion 50 that is directly adjacent to the first surface portion 46 and that does not engage with the bonding layer 44. The second surface portion 50 is formed by a second set of yarn strands 52 (or fibers), which are likewise used to form the textile layer 43. The vortex-generator device 12 might be coupled to the surface 16 in other manners as well. For example, the vortex-generator device 12 might be 3D printed onto the surface 16, ultrasonic welded to the surface 16, molded directly onto the surface 16, or affixed by some other manufacturing technique.

The attachment of the vortex-generator device 12 on the underlying textile layer 43 may operate in various manners in combination with the textile layer 43. For example, if the elongate member is constructed of a material having a higher modulus of elasticity than the textile layer 43, then the first set of yarns strands 48 that are directly engaged with the vortex-generator device 12 may have a lower amount of stretch under a given force as compared with the second set of yarn strands 52 under the same given force. As such, coupling the vortex-generator device 12 to the textile layer 43 might create an amount of lockout or higher compression in particular zones or regions of the article 10. In some instances, the additional compression or lockout might be localized directly beneath the vortex-generator device. And in other aspects, the higher compression and lockout might be realized across a larger region of the garment that is included among the footprint of the vortex-generator device. For example, the region 54 of the article 10 included within the footprint of the vortex-generator device 12 might have a higher modulus of elasticity and more compression than the region 56 of the article 12.

Figure 2A:
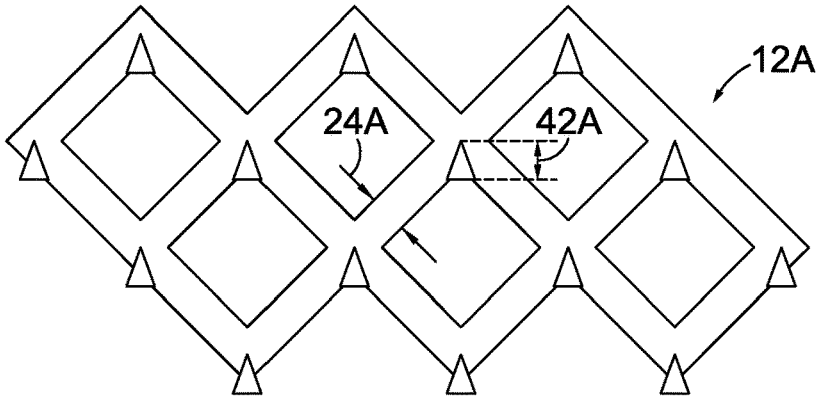
FIGS. 2A, 2B, and 2C each depict a respective vortex-generator device having respective dimensional characteristics in accordance with other aspects of this disclosure.
Figure 2B:
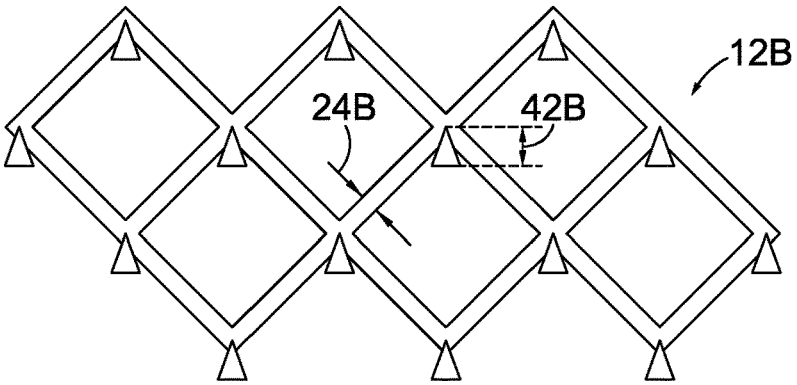
Figure 2C:
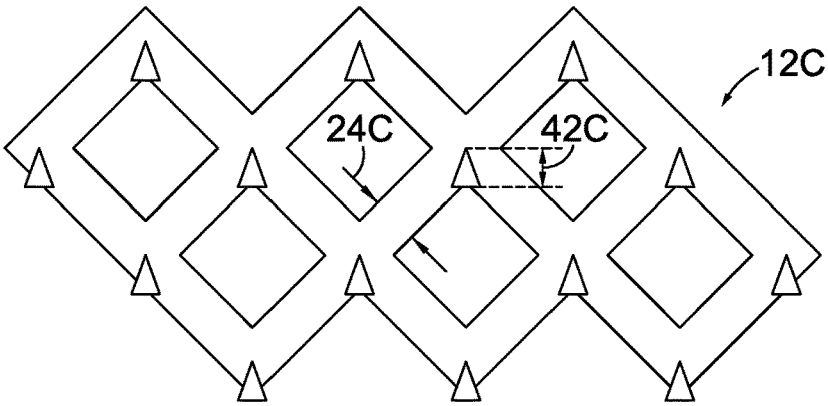

The vortex-generator device 12 includes relative dimensions between the vortex generator 18 and the elongate member 14, which may at least partially determine a degree to which the vortex-generator device affects properties of the article. To further illustrate this aspect of the present disclosure, FIGS. 2A-2C depict alternative vortex-generator devices 12A, 12B, and 12C, respectively, in which the relative sizes of the elongate members and the vortex-generator length varies. For example, in FIG. 2A, the vortex-generator length 42A is similar to the elongate-member width 24A; in FIG. 2B, the vortex-generator length 42B is larger than the elongate-member width 24B; and in FIG. 2C, the vortex-generator length 42C is smaller than the elongate-member width 24C. The dimensionality of the vortex-generator device 12 may operate in various manners to affect one or more properties of the article. In one aspect, the respective size of the elongate member relative to the vortex generator may balance the added stabilization of the vortex generators (as provided by the elongated member) with an amount of additional weight and an amount of additional compression or lockout contributed by the elongate member. For example, in instances in which greater compression and lockout is desired, the elongate member may be configured to include a larger width, such as in FIG. 2C. And to achieve lower amounts of compression, the configuration of FIG. 2B might be constructed. In this sense, the size of the elongate members may be tuned to achieve desired features and functionality.

As such, the relative dimensions of the elongate members and the vortex generators may vary. In accordance with an aspect of the present disclosure, the elongate-member width and the vortex-generator length comprise a ratio in a range of about 1.5:1 to about 0.25:1. For example, if the elongate-member width is about 5 mm, then the vortex-generator length might be in a range of about 6.25 mm to about 7.5 mm, which would provide a ratio in a range of about 0.8:1 to about 0.66:1—and the vortex-generator length might be smaller or larger and still fall within the described ratio. In a further example, if the vortex-generator length is about 7.5 mm, then the elongate-member width might be in a range of about 1.125 cm to about 1.875 mm. These are merely exemplary of some aspects of the disclosure, and in other aspects, the ratio of dimensions within the vortex-generator device may fall outside of this ratio.

As mentioned above, a vortex generator includes a vortex-generator height, which defines how far the vortex generator protrudes from the article surface. The dart-shaped vortex generators include a height, which is maximum at the trailing edge, and any alternative vortex-generator configuration or shape would similarly include a vortex-generator height, which may be at the trailing edge or at any other portion of the vortex generator. In an aspect of the present invention, the vortex-generator height it is a range of about 2 mm to about 6 mm.

Figure 3:
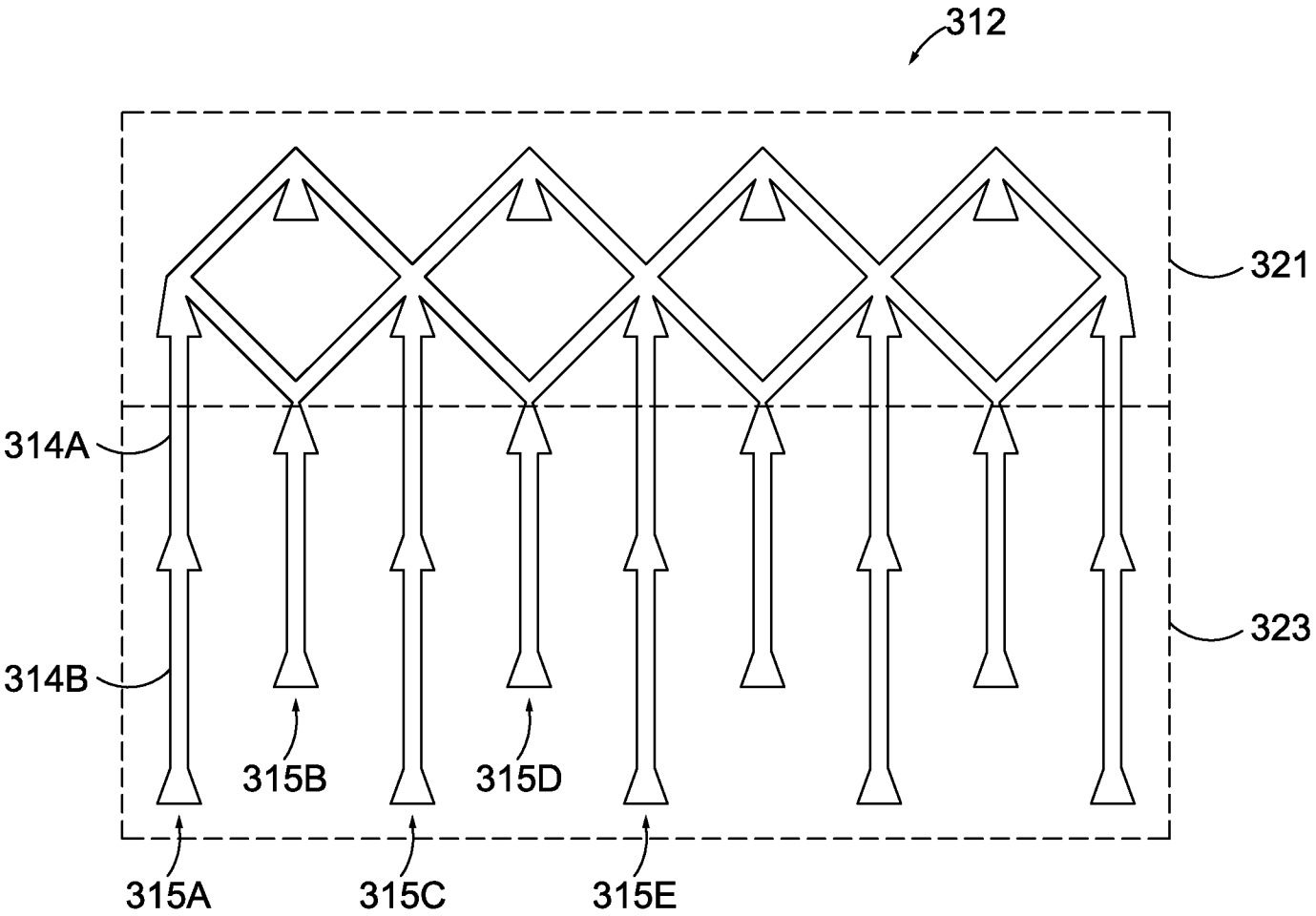
FIG. 3 depicts an alternative vortex-generator device in accordance with an aspect of this disclosure.

A vortex-generator device includes other features. For example, in FIGS. 1A and 2A-2C, the elongate members form a grid structure, or lattice structure, in which each elongate member intersects with another elongate member at a vertex to form an angle. In addition, the lattice structures of FIGS. 1A and 2A-2C arrange the vortex generators in a matrix, in which each vortex generator is positioned near a respective vertex. A vortex-generator device might include other configurations, as well. For example, FIG. 3 depicts an exemplary vortex-generator device 312 in which at least some of the elongate members (e.g., 314A and 314B) are collinear with one another. In addition, the vortex-generator device 312 includes a plurality of different arms 315A-315E that arrange the vortex generators in a matrix. Thus, even though the configuration of the elongate members is different between the vortex-generator devices 12 and 312, the matrix arrangement of the vortex generators is similar (e.g., spacing, density, pattern, etc.).

A configuration of the elongate members (e.g., lattice, discrete arms, etc.) might be selected to affect the underlying article in different manners. For instance, the discrete arms 315A, 315B, and 315C might reduce stretch (and increase compression) by a lesser extent than if the arms 315A, 315B, and 315C were interconnected at each vortex generator. In a further aspect of the present disclosure, the vortex-generator device 312 includes multiple regions 321 and 323, and each region includes a respective set of properties. For example, both regions 321 and 323 include a similar matrix of vortex generators, but the region 321 might reduce stretch of an underlying article more than the region 323.

Figure 4B:
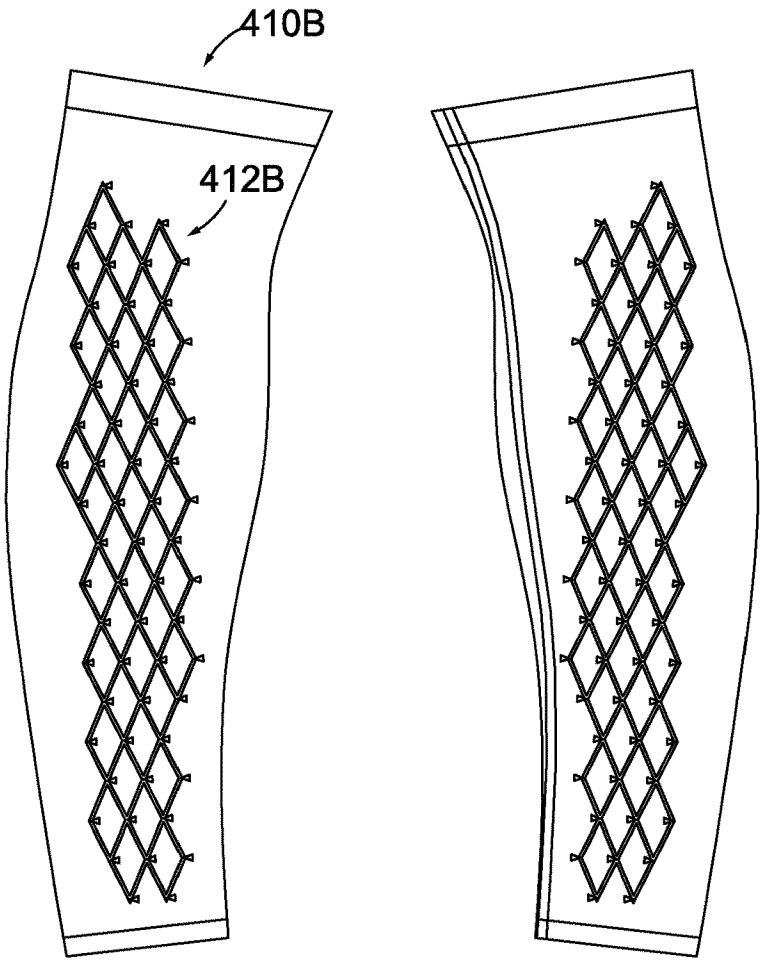
FIGS. 4A and 4B depict other types of articles that might include a vortex-generator device in accordance with aspects of this disclosure.
Figure 4A:
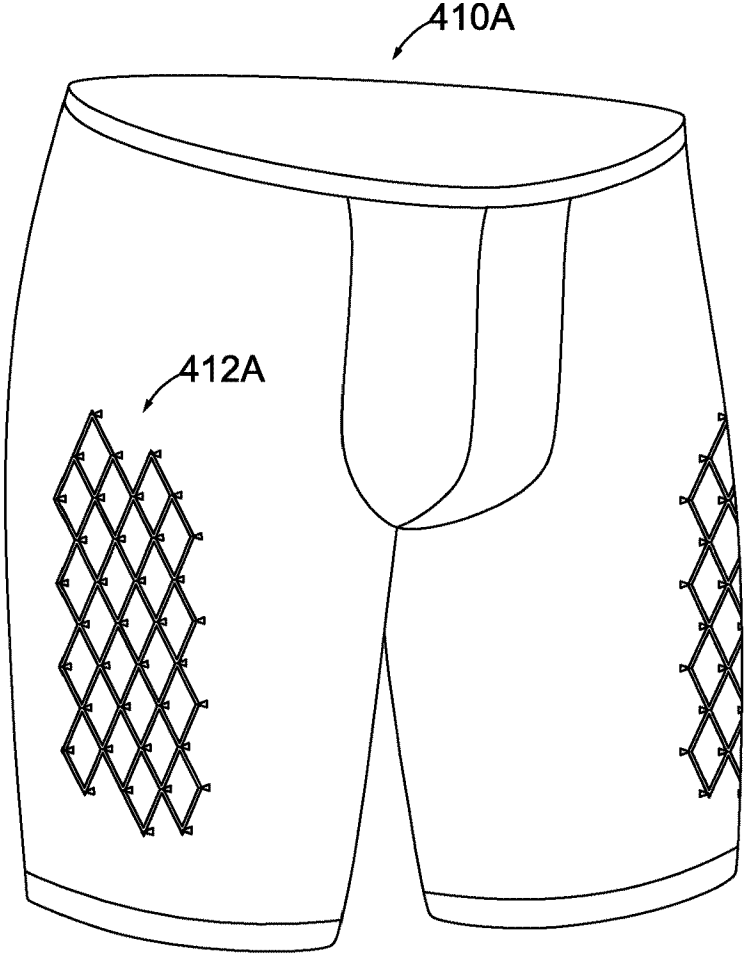

FIG. 1A depicts the article 10 as an upper-body garment, and the vortex-generator device is coupled to a lateral abdominal region. Moreover, the trailing edges are arranged posteriorly, relative to the leading edge. And a vortex-generator device may be coupled to other articles as well. For example, FIG. 4A depicts a vortex-generator device 412A coupled to a leg sleeve of a lower-body garment 410A, such that the trailing edge is arrange posteriorly, relative to the leading edge. As another example, FIG. 4B depicts another vortex-generator device 412B coupled to another type of sleeve 410B, which might be an arm sleeve or a leg sleeve.

Figure 5B:
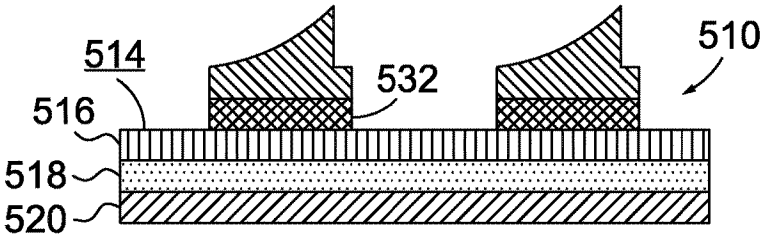
FIG. 5B depicts a cross-section view taken from the cross-section reference plane indicated in FIG. 5A.
Figure 5A:
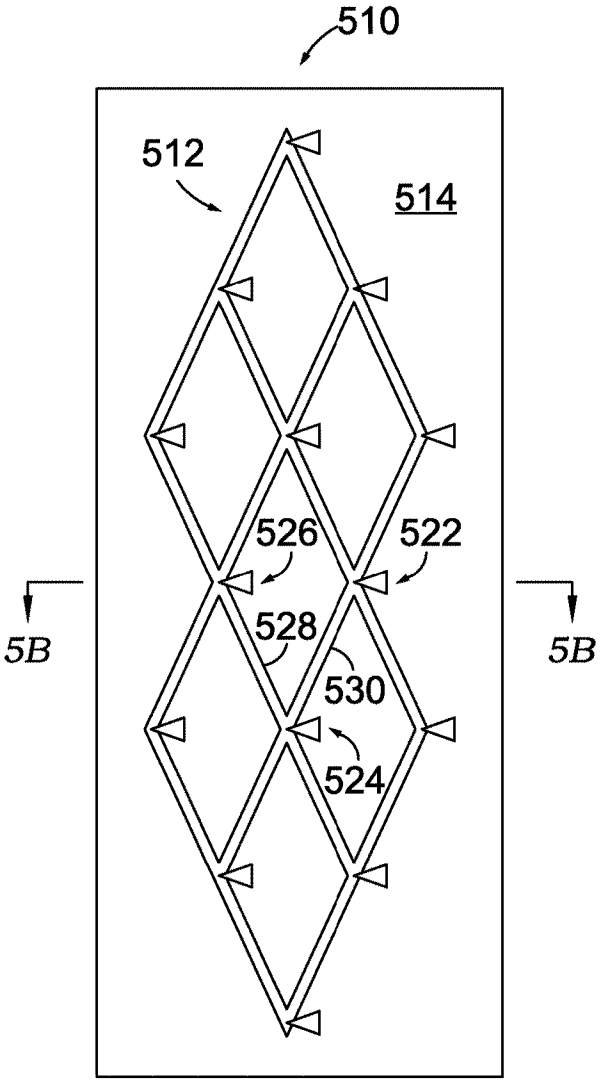
FIG. 5A depicts an adhesive-tape strip coupled with a vortex-generator device in accordance with an aspect of this disclosure.

In addition to article of apparel or clothing accessories, a vortex-generator device might be coupled to other types of articles. Referring to FIG. 5A, in one aspect of the present disclosure, a vortex-generator device 512 is coupled to an adhesive-tape strip 510, which may be selectively and removably affixed (e.g., adhered) to another surface, such as a skin surface, garment surface, equipment surface, and the like.

The strip 510 includes an outward-facing surface 514, which faces away from the surface to which the strip 510 may be removably affixed. The adhesive-tape strip 510 is constructed such that the vortex-generator device 512 is affixed to the outward-facing surface 514. FIG. 5B depicts a cross-sectional, schematic view of the adhesive-tape strip 510, taken across the cross-sectional reference line depicted in FIG. 5A, in accordance with an aspect of the present invention. (The depiction provided by FIG. 5B is schematic in nature and is not necessarily meant to illustrate or depict accurate scaling of layer thickness or vortex-generator-device sizing or spacing). In FIG. 5B, the adhesive-tape strip 510 includes the outward-facing surface 514 of a base-layer substrate layer 516. The base-layer substrate 516 includes a tape material layer, such as a knit, woven, or non-woven textile. The tape material layer may be elastic (e.g., elastomeric and flexible fabric) configured to stretch uni-directionally (e.g., in length) or bi-directionally (e.g., length and width) to provide a desired force against an applied-to surface (e.g., an athlete's skin surface). In addition, the base-layer substrate 516 might be designed to provide a desirable amount of breathability and/or moisture tolerance. The base-layer substrate 516 might be constructed of a natural fiber (e.g., cotton), a synthetic fiber, or a combination thereof. In one aspect, the base-layer substrate 516 is a type of base-layer substrate used to construct elastic therapeutic tape (e.g., kinesio tape).

The adhesive-tape strip 510 also includes a first adhesive layer 518 applied to an inward-facing surface of the base-layer substrate 516, the inward-facing surface generally opposing the outward-facing surface 514 and facing towards a surface to which the strip 510 is removably affixed. The first adhesive layer 518 might have various properties making the adhesive-tape strip 510 suitable for application to human skin in a therapeutic or supportive context, such as non-irritation properties, heat-activation properties, and the like.

In one aspect, the adhesive-tape strip 510 includes a removable backing layer 520 that covers the adhesive layer 518 prior to the strip 510 being applied to a surface. The removable backing layer 520 can then be peeled away from the strip 510 to uncover the adhesive layer 518. However, in other aspects, the removable backing layer 520 might be omitted, and the strip 510 may be rolled up to cover the adhesive layer prior to applying the strip to a surface.

As described with respect to FIGS. 1A-1C, the vortex-generator device 512 includes a plurality of vortex generators 522, 524, and 526 that are interconnected by one or more elongate members 528 and 530. Furthermore, the vortex-generator device 512 is affixed to the adhesive-tape strip 510 by a bonding layer 532.

Figure 6:
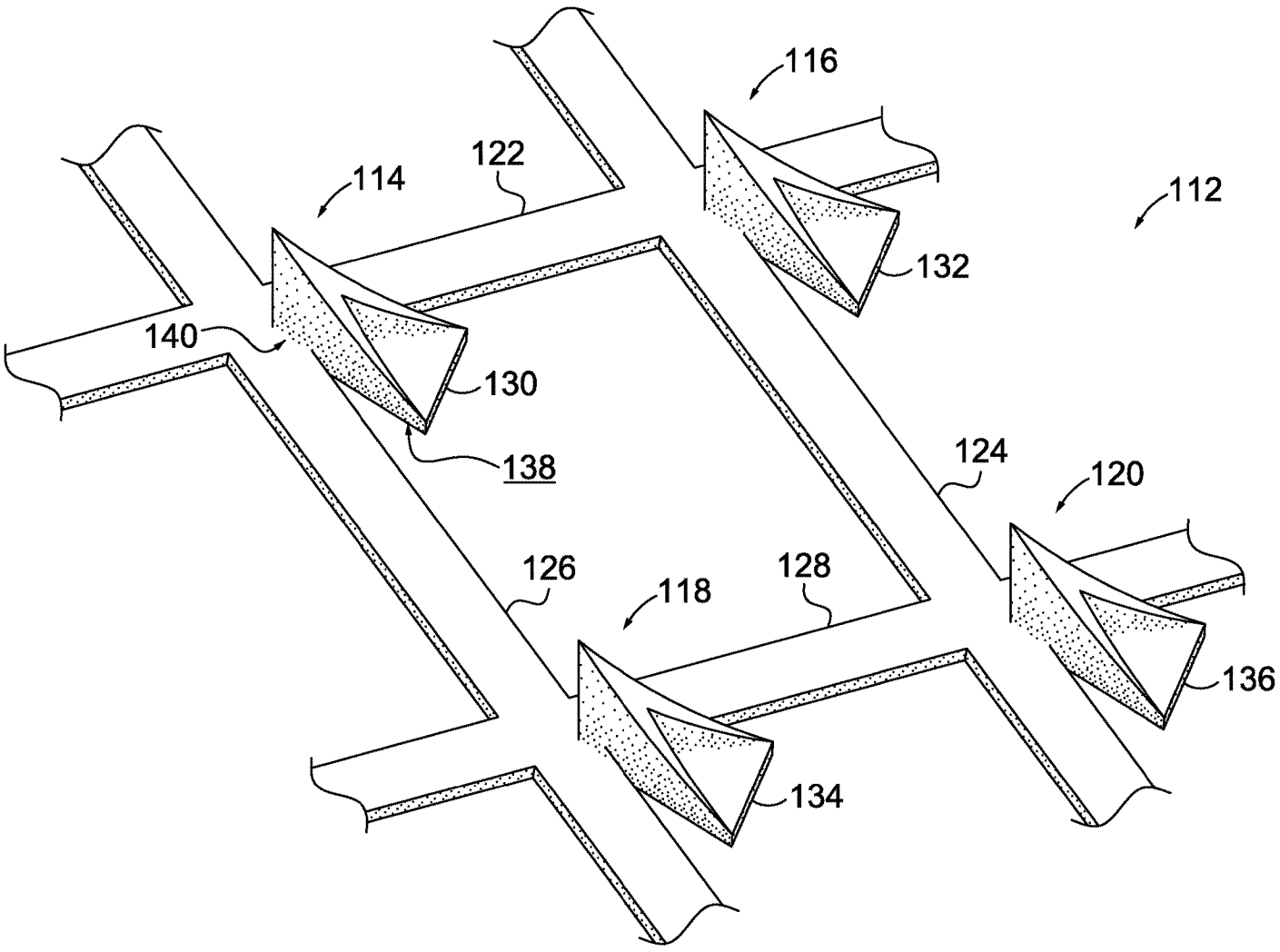
FIG. 6 depicts a perspective view of a vortex-generator device in accordance with an aspect of this disclosure.

Vortex generators might be coupled to the one or more elongate members in various manners. For example, the vortex generators might be coupled to the elongate member, such as by bonding, ultrasonic welding, curing, and the like to an exterior surface (e.g., surface 34 in FIG. 1B). In other aspects, the vortex generators and the elongate members might be molded or 3D printed to include a unitary construction. Referring to FIG. 6, an illustrative depiction shows a vortex-generator device 112, which includes a plurality of vortex generators 114, 116, 118, and 120 that are interconnected by a grid of elongate members 122, 124, 126, and 128. Each of the vortex generators 114, 116, 118, and 120 includes a respective base 130, 132, 134, and 136. As depicted, the vortex-generator bases 130-136 extend beyond the footprint of the elongate members. As such, an underneath-side surface (e.g., surface 138 of vortex generator 114) might also be attachable to an article (in addition to the underneath-side surface of the elongate members), such as by the bonding layer 44 described with respect to FIGS. 1B and 1C. Attachment of both the vortex-generator bases and the elongate members to the underlying article may provide additional stability to the vortex-generator device 112. Further, in accordance with aspects depicted in FIG. 6, one of the elongate members (e.g., the elongate member 122) is directly connected to at least one neighboring elongate member (e.g., the elongate member 126). In an additional aspect, an opening is formed between the elongate member (e.g., the elongate member 122) and the at least one neighboring elongate member (e.g., the elongate member 126).

In one aspect of the present disclosure, the vortex generators 114-120 and the elongate members 122-128 are integrally molded from a same material, which might include a polyurethane (PU), a silicone-rubber composition, or some other elastomeric polymer. In other instances, the vortex-generators 114-120 and the elongate members 122-128 might be co-molded (e.g., in a two-step process) from the different materials to achieve different sets of material properties. In each of these instances, a unitary construction may be achieved by molding both the vortex generators and the elongate members together. Among other things, a unitary construction may improve an interface 140 between the vortex generator 114 and the elongate member 126, such that the interface 140 is stronger and less susceptible to disconnecting or tearing (as compared to constructing the vortex generators separately from the elongate members and affixing the two parts together with another coupling mechanism).

Figure 7:
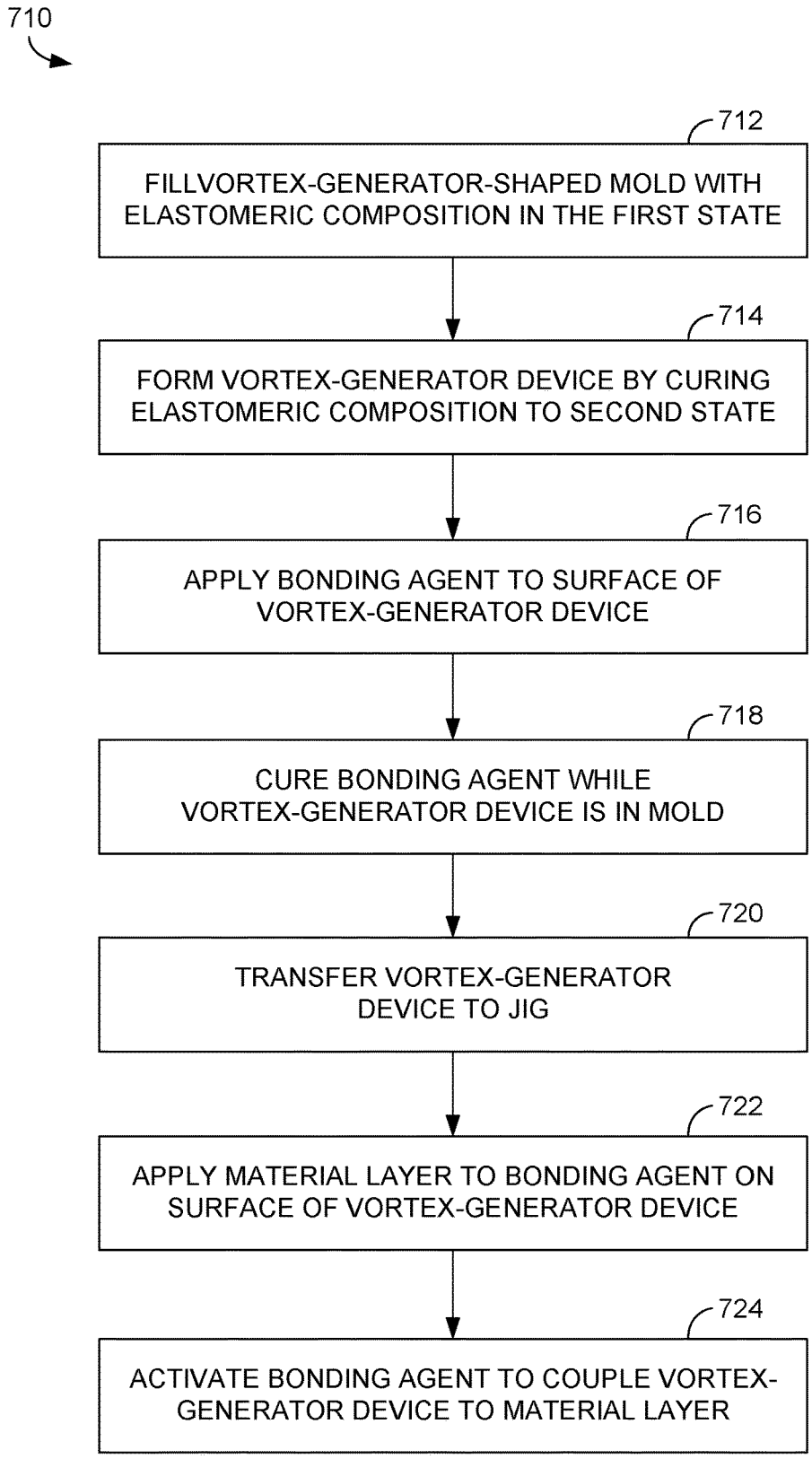
FIG. 7 depicts a flow chart showing steps performed in a method of making a vortex-generator device and coupling the vortex-generator device to an article in accordance with an aspect of this disclosure.

Referring now to FIG. 7 a method 710 of manufacturing an article having a vortex-generator device will now be described. At step 712, a vortex-generator-device mold is filled with an elastomeric composition in a first state. For example, the mold might be filled with a silicon-rubber composition in an uncured state. In addition, the mold might include a plurality of vortex-generator-shaped depressions or cavities having a first depth and one or more grooves connecting the vortex-generator shaped depressions to one another. The one or more grooves include a second depth that is less than the first depth, the second depth being measured from a mouth or opening of the groove to a base of the groove. Step 714 includes curing the elastomeric composition to a second state while the elastomeric composition is in the vortex-generator-device mold, the elastomeric composition forming a vortex-generator device when cured. In addition, step 716 includes applying a bonding agent to a surface of the vortex-generator device, the surface positioned at a mouth of the one or more grooves, and step 718 includes curing the bonding agent while the vortex-generator device is in the vortex-generator-device mold.

Figure 8:
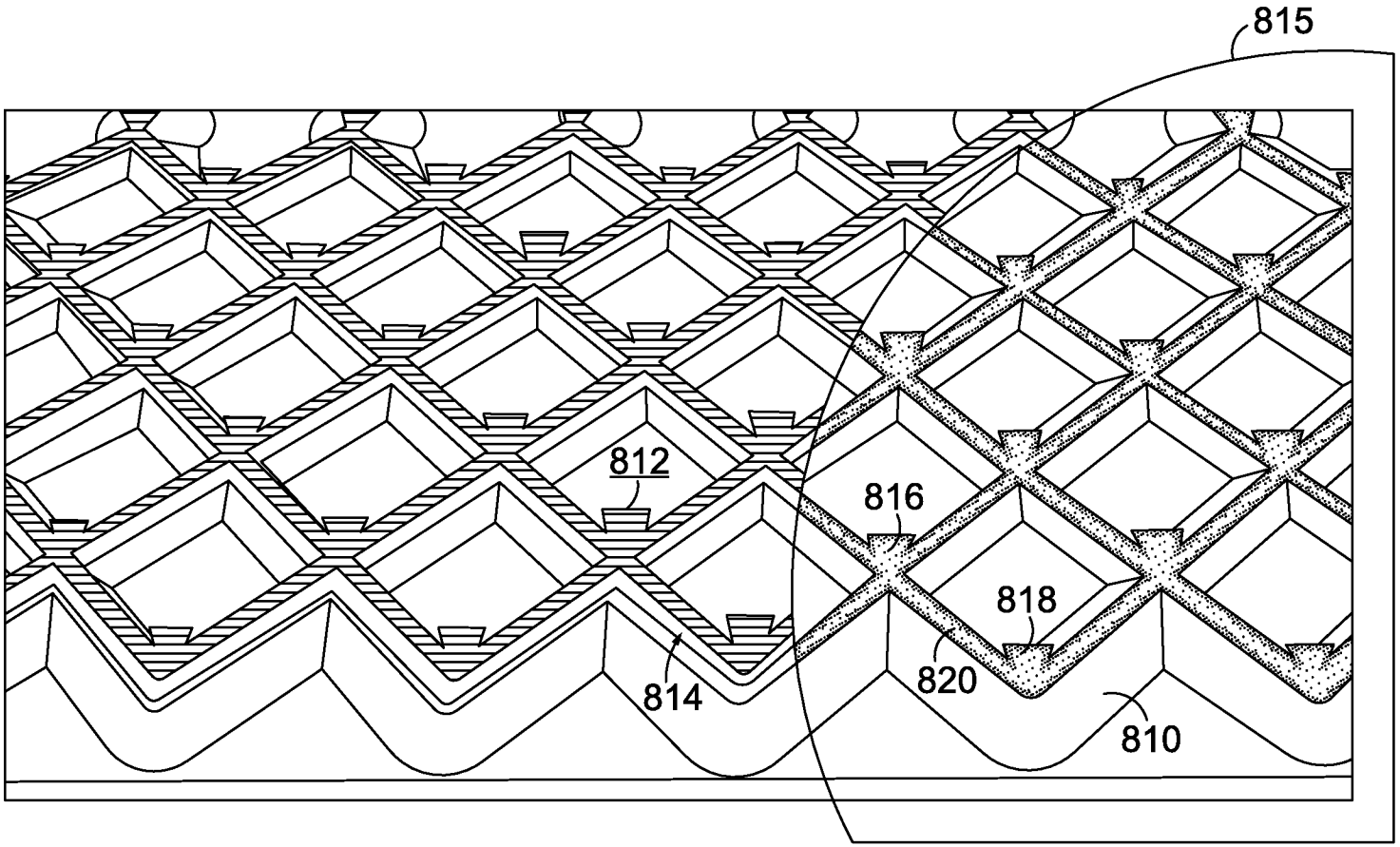
FIG. 8 depicts a jig for attaching a vortex-generator device to an article in accordance with an aspect of this disclosure.

At step 720, the vortex-generator device is transferred to a jig (also referred to as a carrier block). The jig includes cavity shapes that are complementary to the vortex-generator device, such that the vortex-generator device nests upside down in the jig with the surface having the bonding agent is exposed. In some aspects, a transfer sheet might be affixed to the bonding layer of the vortex-generator device after the bonding agent is cured and before the vortex-generator device is transferred to the jig. And in other aspects, the vortex-generator device might be transferred to the jig without applying any transfer sheet to the bonding agent. An exemplary jig 810 is illustrated in FIG. 8, which depicts bonding surface 812 of an exemplary vortex-generator device 814. For illustrative purposes, FIG. 8 omits portions of the vortex-generator device 814 that would be included inside the cutout portion 815 and that would otherwise obscure the complimentary portions 816, 818, and 820 of the jig 810. The complimentary portions 816 and 818 include vortex-generator-shaped depressions or cavities having a first depth, and the complimentary portion 820 includes a groove connecting the vortex-generator shaped depressions to one another. The one or more grooves may include a second depth that is less than the first depth, and in this sense, the jig 810 may share some similar dimensions with the mold. The portions 816, 818, and 820 are configured to seat complimentary portions of vortex generators and elongate members, respectively, for attachment to an article.

Step 722 includes applying a material layer (e.g., material layer of article of apparel or material layer of adhesive-tape strip) to the surface with the bonding agent, while the vortex-generator device is in the jig. If a transfer sheet was applied, then the transfer sheet is removed prior to applying the textile layer. At step 724, the bonding agent is activated (e.g., heat, pressure, UV, etc.) to couple the vortex-generator device to the material layer.

From the foregoing, it will be seen that this subject matter is adapted to attain ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims. Since many possible variations and alternatives may be made of the subject matter without departing from the scope thereof, it is to be understood that all matter herein set forth or shown in the accompanying drawings is to be interpreted as illustrative and not in a limiting sense.

The invention claimed is:

1. An article of apparel comprising:

a material layer;

an elongate member coupled to a surface of the material layer, the elongate member having an elongate-member length and an elongate-member width, wherein the elongate-member width is less than the elongate-member length, wherein the surface includes a first surface portion that is coupled to the elongate member and a second surface portion that is directly adjacent to the first surface portion and that is not coupled to the elongate member, wherein the elongate member is directly connected to at least one neighboring elongate member, and further wherein an opening is formed between the elongate member and the at least one neighboring elongate member; and a first vortex generator and a second vortex generator each coupled to the elongate member, such that the elongate-member length extends from the first vortex generator to the second vortex generator, wherein each of the first vortex generator and the second vortex generator comprises a leading edge and a trailing edge opposite the leading edge, the leading edge and the trailing edge defining a vortex-generator length therebetween; and wherein the elongate-member width and the vortex-generator length comprise a ratio in a range of about 1.5:1 to about 0.25:1.5.

2. The article of apparel of claim 1, wherein the article of apparel further comprises a bonding agent layered directly between the elongate member and the first surface portion, the bonding agent coupling the elongate member to the first surface portion.

3. The article of apparel of claim 1, wherein the first surface portion comprises a first set of yarn strands having a first amount of stretch, and wherein the second surface portion comprises a second set of yarn strands having a second amount of stretch, which is greater than the first amount of stretch.

4. The article of apparel of claim 1, wherein the first vortex generator includes a first underneath-side surface coupled directly to the surface of the material layer, and wherein the second vortex generator includes a second underneath-side surface coupled directly to the surface of the material layer.

5. The article of apparel of claim 1, wherein the elongate member and the first vortex generator and the second vortex generator comprises a same material and include a unitary construction.

6. The article of apparel of claim 5, wherein the same material comprises a silicone composition.

7. The article of apparel of claim 5 further comprising, a second elongate member coupled to the surface of the material layer and to the second vortex generator, the second elongate member including a second elongate-member length and a second elongate-member width; and a third vortex generator coupled to the second elongate member, the second elongate-member length extending from the second vortex generator to the third vortex generator, wherein the second elongate member and the third vortex generator comprise the same material and comprise a part of the unitary construction.

8. The article of apparel of claim 7, wherein the first, second, and third vortex generators are aligned in a collinear orientation.

9. The article of apparel of claim 7, wherein the elongate member and the second elongate member form an acute angle, and wherein the second vortex generator is positioned at a vertex of the acute angle.

10. The article of apparel of claim 1, wherein the vortex-generator length is greater than the elongate-member width.

11. The article of apparel of claim 1, wherein the leading edge of the first vortex generator faces towards a same direction as the leading edge of the second vortex generator.

12. The article of apparel of claim 11, wherein the article of apparel is an upper-body garment, wherein the elongate member is coupled to a lateral abdomen region of the upper-body garment, and wherein the trailing edge is arranged posteriorly, relative to the leading edge.

13. The article of apparel of claim 11, wherein the article of apparel is a lower-body garment, wherein the elongate member is coupled to a leg sleeve of the lower-body garment, and wherein the trailing edge is arrange posteriorly, relative to the leading edge.

14. The article of apparel of claim 11, wherein the article of apparel is an adhesive-tape strip, and wherein the material layer comprises a second surface that opposes the surface and that comprises an adhesive layer.

15. An article with a vortex-generator device, the article comprising:

a material layer having a surface, the surface having a first surface portion and a second surface portion, the second surface portion being directly adjacent to the first surface portion;

a plurality of elongate members that are coupled to the first surface portion and that are interconnected with one another, the second surface portion not coupled to any elongate member, wherein each elongate member of the plurality of elongate members includes an elongate-member length and an elongate-member width, wherein the elongate-member width is less than the elongate-member length;

wherein at least two elongate members included in the plurality of elongate members directly intersect with one another at a vertex to form an angle; and wherein an opening is formed between the at least two elongate members; and a plurality of vortex generators that are coupled to the plurality of elongate members and that protrude away from the surface, wherein each elongate-member length extends between a respective pair of vortex generators, and wherein at least one of the plurality of vortex generators is coupled at the vertex;

the first surface portion comprising a first set of yarn strands having a first amount of stretch and the second surface portion comprising a second set of yarn strands having a second amount of stretch, which is greater than the first amount of stretch, wherein the first set of yarn strands and the second set of yarn strands are the same type of yarn and the second surface portion is adjacent the opening.

16. The article of claim 15, wherein the material layer forms at least a portion of a garment or an adhesive-strip body.

17. The vortex-generator device of claim 15, wherein the plurality of elongate members includes a plurality of consistent elongate-member lengths, and wherein each of the respective pair of vortex generators is coupled to a respective vertex.

* * * * *